US005580277A

United States Patent [19]

Emery

[11] Patent Number: 5,580,277

[45] Date of Patent: Dec. 3, 1996

[54] ANTENNA CABLE CONNECTOR

[75] Inventor: William M. Emery, Swanton, Ohio

[73] Assignee: Solar Conversion Corp., Holland, Ohio

[21] Appl. No.: 339,803

[22] Filed: Nov. 15, 1994

[51] Int. Cl.[6] ..... H01R 9/05

[52] U.S. Cl. ..... 439/582; 439/916; 439/939; 343/888; 343/906

[58] Field of Search ..... 343/715, 888, 343/905, 906; 439/582, 916, 939

[56] References Cited

U.S. PATENT DOCUMENTS

| | | | |
|---|---|---|---|
| 2,668,187 | 2/1954 | Wald | 343/906 |
| 3,059,047 | 10/1962 | Rogers | 343/888 |
| 3,444,313 | 5/1969 | Goodchild | 343/906 |
| 4,882,591 | 11/1989 | Galvin et al. | 343/906 X |
| 4,987,422 | 1/1991 | Ryan | 343/888 X |
| 5,061,940 | 10/1991 | Blaese | 439/916 X |

FOREIGN PATENT DOCUMENTS

| | | | |
|---|---|---|---|
| 2299182 | 12/1990 | Japan | 343/906 |

*Primary Examiner*—Donald T. Hajec
*Assistant Examiner*—Tho Phan
*Attorney, Agent, or Firm*—William P. Hickey

[57] ABSTRACT

A connector for connecting a transmission cable to an antenna. The construction utilizes a rugged machine screw for holding the cable to the antenna, and is provided with a contact plate embedded in a plastic body which both seals the cable connections to the plate and machine screw and isolates the contact plate from the atmosphere when attached to the antenna.

7 Claims, 2 Drawing Sheets

ANTENNA CABLE CONNECTOR

TECHNICAL FIELD

The present invention relates to new sturdy, and inexpensive means for connecting transmission line cables to antennas.

BACKGROUND OF THE INVENTION

Presently electronic equipment including antennas are connected to transmission line cables by connectors known as SO-239 and PL-259. These male and female connectors are quite expensive even though they are made by the millions and used all over the World. These connectors comprise a number of automatic screw machine parts and complicated insulators and when installed outdoors are subject to corrosion, shorting and/or an open circuit.

Accordingly, it is an object of the present invention to produce a new and improved inexpensive and rugged connector for use between cables and antennas.

Another object of the present invention is the provision of a new and improved antenna transmission line connector that is capable of supporting long whips on moving vehicles.

Another object of the present invention is the provision of a new and improved connector of the above described type that automatically seals all electrical contacts from moisture when it is installed to an antenna.

Further objects and advantages of the invention will become apparent to those skilled in the art to which the invention relates from the following description of the preferred embodiment.

BRIEF SUMMARY OF THE INVENTION

In order to achieve the objects of the invention the structural parts of the connector are designed to perform a dual function, namely to be not only the supporting structure of the antenna, but its electrical connections as well.

The invention generally comprises a headed threaded axially extending member which can be a machine screw. Surrounding the shank of the screw is an annular, stepped electrically insulating washer, since the machine screw is to become one terminal of the transmission line. Surrounding the small diameter section of the stepped insulating washer is an annular contact plate having anchors that project generally parallel to the sides of the head of the machine screw but spaced annularly there from. One conductor of the transmission line is suitably connected to the head of the machine screw and another conductor of the transmission line is connected to the annular contact plate. The head of the bolt has a hole in the top of its head and a plastic spacer element is lodged in the hole. The assembly thus for described is placed in a suitable cavity of an injection molding machine, not shown, the molding cavity of which does several things. It bears against the plastic spacer element to hold the assembly securely enough that the plastic under pressure does not lift the contact plate away from its seal in the mold; and it forms a sealing surface which surrounds the contact plate. All this will be made clear from the description of the preferred embodiment which follows.

It will be seen that the invention is capable of using any size machine screw, so that there is substantially no limit to the ruggedness of the cable connector which can be made, and in every instance, a corrosion proof connection of the antenna with its supports will be provided.

DESCRIPTION OF THE PREFERRED EMBODIMENT

Figure 1:
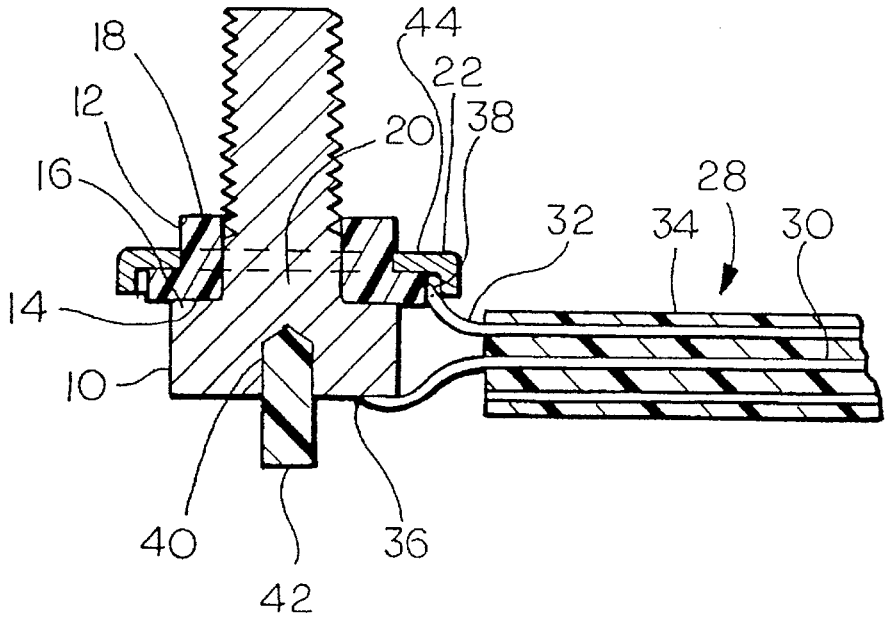
FIG. 1 the drawing is a longitudinal cross sectional view of the assembled parts before being encased by its plastic housing.

The single embodiment shown in the drawings generally comprises a hexagonally headed machine screw 10 having a stepped insulating washer 12 positioned with its large diameter portion 14 in engagement with the shoulder 16 of the headed machine screw and its small diameter portion 18 extending over the shank 20 of the machine screw 10. An annular contact plate 22 made of a square piece of brass is stamped into an annular shape, to cause its edges, including its corner portions 24, to be turned inwardly generally parallel to the head of the machine screw, but spaced slightly from its head and the stepped insulating washer 12.

The contact plate 22 has a centrally located hole 24 there through to receive the small diameter portion 18 of the insulating washer 12. An electrical transmission line 28 having a center conductor 30 and an outer braided shielding 32 is positioned with an end adjacent the head of the machine screw and with its center conductor 30 projecting out of the insulation 34 of the transmission line 28 and soldered to the head of the machine screw, as at 36. A section of the braided shielding 32 is twisted together to form a lead that also projects out of the insulation, and is soldered to the contact plate 22, as at 38, adjacent a corner portion 24, which acts as a soldering tab.

The head of the machine screw has an axially extending hole 40 drilled therein to receive a plastic spacer member 42, for reasons which will later be explained. The assembly so far described is placed in a two piece injection molding die, with one piece positioned tightly against the outer portion of the contact plate 22, and the other section of the die having a cavity which surrounds the portion of the assembly so far described. The other section of the cavity extends away from the contact surface 44 of the contact plate 22, and completely covers the head of the machine screw, and the end of the transmission line 28. The cavity also includes a side portion which receives the end of the transmission line to form an appendage 46 for the finish molded part, and which will stiffen the end of the transmission line where stresses are normally concentrated.

Figure 2:
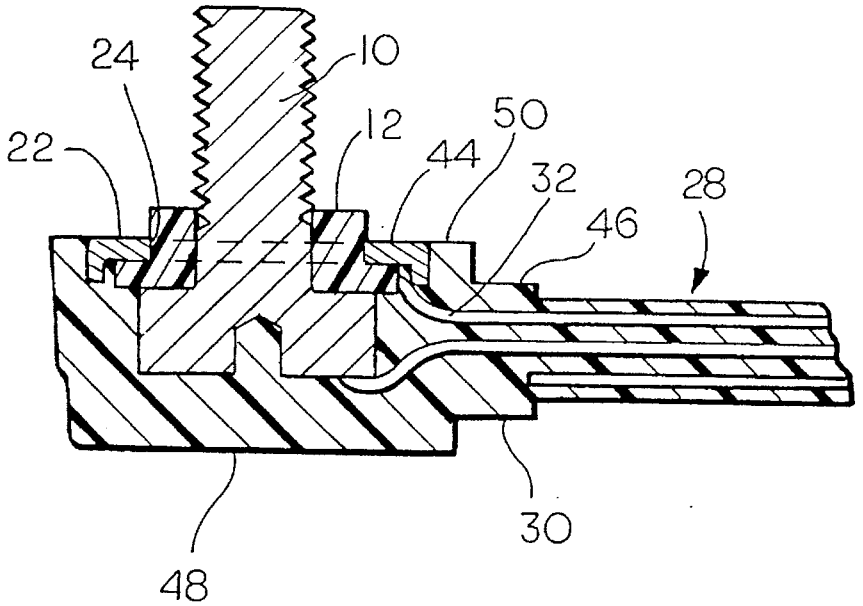
FIG. 2 of the drawing is a longitudinal cross sectional view of the finished assembly.
Figure 3:
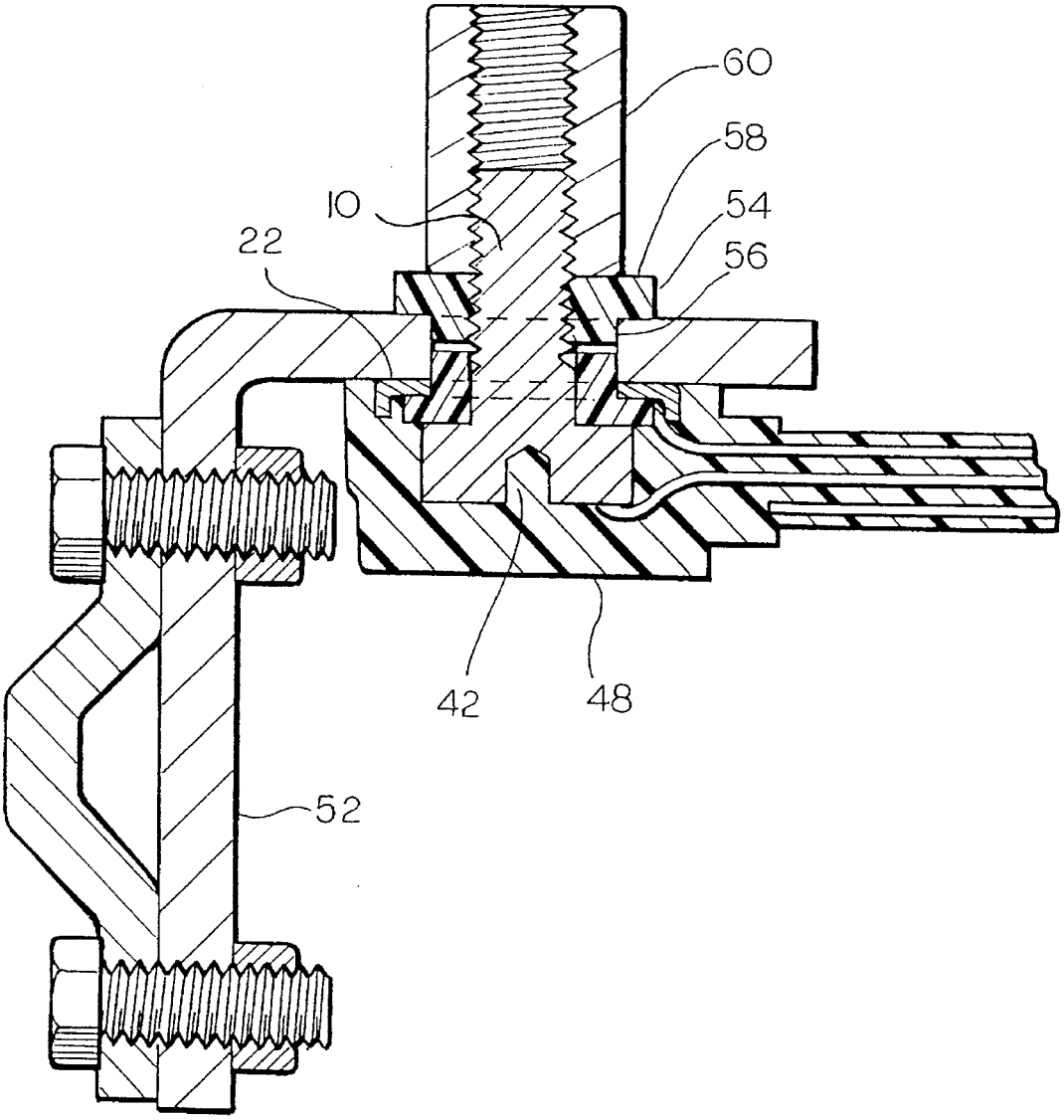
FIG. 3 is a longitudinal cross sectional view of the assembly and its attachment mechanism to an antenna support structure.

It has been discovered that plastic in the normal molding process will find its way in over the contact surface 44, and cause expensive clean up to provide a good clear contact surface. It has been found that this expensive clean up process can be prevented if the plastic spacer member 42 is caused to be slightly longer than is the space between the head of the machine screw and the surface of the mold cavity. The plastic spacer member 42 will be resilient enough and provide enough pressure between the contact surface 44 and the face of the other section of the mold, so that very little if any clean up of the contact surface 44 is required after molding. The resulting structure is as shown in FIG. 2. If the spacer member 42 is made of the same plastic as is the plastic used in the injection molding process, the plastic body 48 so formed will be fused to the spacer member so as to be indistinguishable therefrom, and provide a complete seal. The plastic body 48 will include an annular plastic sealing surface 50 surrounding the contact plate 22, to prevent water, etc. from reaching the contact surface 44, as will be later explained. The sealing surface 50 may include an annular groove, not shown, for receiving an O-ring in some instances.

One of the advantages of the structure so far described is that it provides a very rugged structure for supporting long whip antennas, not shown. The support structure shown includes an aluminum angle bracket 52 having a hole through one leg to receive the small diameter portion 18 of the insulating washer 12. Another stepped insulating washer 54 is positioned on top of the angle bracket 52, with its small diameter portion 56 received tightly in the hole of the angle bracket 52, and its large diameter portion 58 bearing against the angle bracket. An internally threaded sleeve 60 is screwed tightly over the threads of the machine screw 10, with a sizeable portion of the sleeve 60 projecting outwardly from the machine screw, to receive the threaded end of a whip antenna not shown—all as will be readily understood by those skilled in the art. Mobile whip antennas as long as 6 feet or more can be safely supported by the cable connector of the present invention.

While the invention has been described in considerable detail, I do not wish to be limited to the embodiment shown and described; and it is my intention to cover hereby all novel adaptations, modifications, and arrangements thereof which come within the practice of those skilled in the art to which the invention relates, and which come within the purview of the following claims.

I claim:

1. An antenna cable connector, comprising:

an axially extending threaded rod-shaped member having a head at one end, a threaded rod-shaped portion, and a shoulder between said head and its threaded rod-shaped portion;

an annular stepped electrically insulating washer extending around said threaded rod-shaped member, said stepped washer having a large diameter portion adjacent said head and a smaller diameter portion projecting away from said head;

an annular contact plate seated on said stepped washer laterally of said small diameter portion of said stepped washer;

an electrical cable terminating adjacent said head portion of said rod-shaped member having a first conductor connected to said head, a second conductor connected to said contact plate, and electrical insulation covering said conductors; and a plastic body surrounding said head, and sealed to said contact plate, and to said insulation of said electrical cable.

2. The connector of claim 1 wherein said plastic body includes a lateral appendage which surrounds a portion of said cable adjacent said plastic body.

3. The connector of claim 1 wherein said plastic body has an annular sealing surface outwardly of said annular contact plate.

4. The connector of claim 3 wherein said plastic body has an annular groove in said annular sealing surface.

5. An antenna mount comprising:

a support bar having first and second opposite sides with a hole therebetween;

a grounding plate contacting said first side of said support bar, and having a hole there through;

a first annular stepped insulating washer having a hole there through, with a large diameter portion bearing against said grounding plate, and a small diameter section extending through said hole of said grounding plate and into said hole of said support bar;

a second annular stepped insulating washer having a large diameter potion positioned against said second side of said support bar, and a small diameter portion in said hole of said support bar;

a headed fastener having a threaded portion extending through said holes of said stepped insulating washers and a head bearing against said large diameter portion of said first stepped insulating washer;

an internally threaded sleeve threaded onto said threaded portion of said fastener;

an electrical cable having a first conductor connected to said head, and a second conductor connected to said grounding plate with electrical insulation covering said conductors; and a plastic body laterally surrounding said head, and surfaces of said grounding plate not in contact with said first side of said support bar, said plastic body being sealed to said electrical insulation of said electrical cable.

6. The antenna mount of claim 5 wherein said plastic body has a lateral appendage surrounding a portion of said cable adjacent said body.

7. The antenna mount of claim 6 wherein said plastic body includes an annular sealing surface surrounding said grounding plate.

* * * * *